US006575114B2

(12) United States Patent
Sandler et al.

(10) Patent No.: US 6,575,114 B2
(45) Date of Patent: Jun. 10, 2003

(54) HUMAN CONTROLLED TOWABLE DEVICE FOR WATER SURFACE AND SUBSURFACE OPERATION

(76) Inventors: Richard H. Sandler, 719 Forest Ave., Evanston, IL (US) 60052; Hussein A. Mansy, 8916 W. 85th Pl., Justice, IL (US) 60458

( * ) Notice: Subject to any disclaimer, the term of this patent is extended or adjusted under 35 U.S.C. 154(b) by 0 days.

(21) Appl. No.: 09/897,327

(22) Filed: Jul. 2, 2001

(65) Prior Publication Data

US 2003/0000446 A1 Jan. 2, 2003

(51) Int. Cl.[7] ..... B63C 11/46
(52) U.S. Cl. ..... 114/315; 114/244
(58) Field of Search ..... 114/315, 242, 114/245, 244, 246, 253

(56) References Cited

U.S. PATENT DOCUMENTS 3,160,133 A * 12/1964 Walker ..... 114/315
3,261,318 A * 7/1966 Jones et al. ..... 114/315
3,898,759 A 8/1975 Jensen ..... 43/43.13
3,931,777 A * 1/1976 Colgan ..... 114/315
4,028,840 A 6/1977 Wille ..... 43/43.13
4,624,207 A * 11/1986 King ..... 114/315
5,548,919 A 8/1996 Hicks ..... 43/43.13
5,655,939 A 8/1997 Salvadores ..... 441/65

* cited by examiner

*Primary Examiner*—Ed Swinehart
(74) *Attorney, Agent, or Firm*—Grossman & Flight

(57) ABSTRACT

A device for use in human controlled water surface and subsurface travel includes a towbar having first and second end portions. The device includes a first control member that is rotatably coupled to the towbar adjacent to the first end portion and the first control member has a first control surface and a second control surface opposite the first control surface. The device further includes a second control member rotatably coupled to the towbar adjacent to the second end portion and spaced from the first control member, and the second control member has a third control surface and a fourth control surface opposite the third control surface. The device further includes first and second grips spaced apart and fixed to the towbar between the first and second control members so that rotation of the first and second grips about a longitudinal axis of the towbar enables the first and second control members to be independently rotated about the longitudinal axis of the towbar.

32 Claims, 14 Drawing Sheets

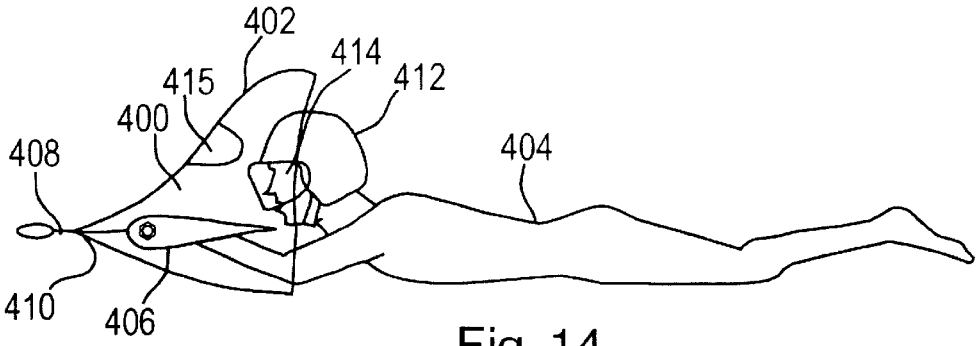
Fig. 14
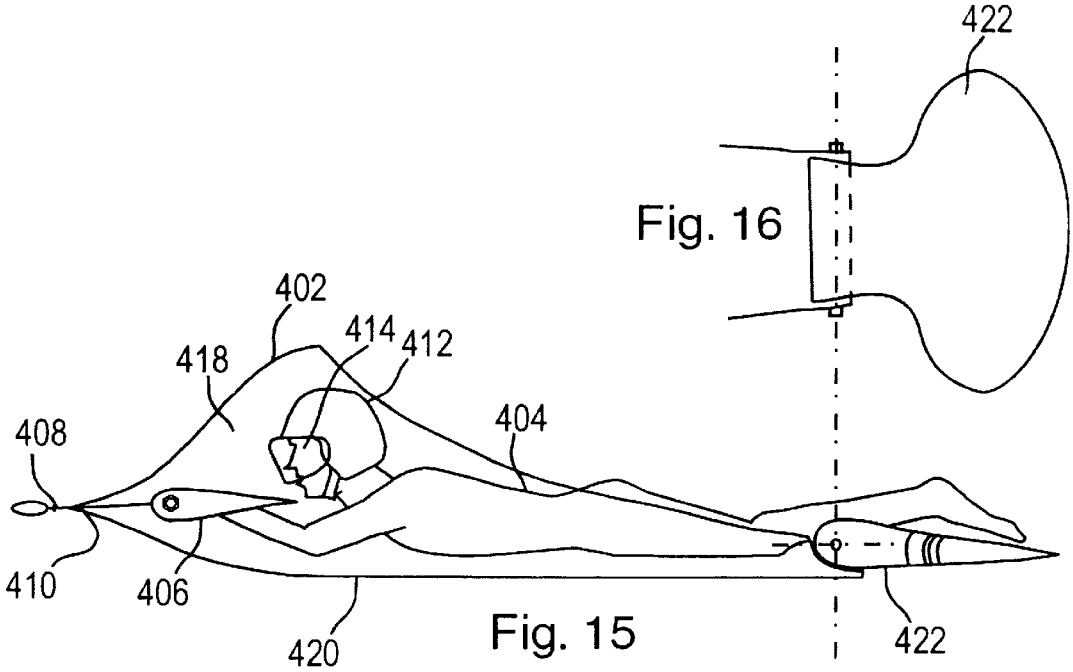
Fig. 16
Fig. 15

HUMAN CONTROLLED TOWABLE DEVICE FOR WATER SURFACE AND SUBSURFACE OPERATION

BACKGROUND OF THE INVENTION

1. Field of the Invention

The invention relates generally to towable devices for travel in a body of water and, more particularly, the invention relates to a human controlled towable device that may be maneuvered on and below the water surface.

2. Description of Related Technology

A variety of well known human controlled towable water sport devices such as water skis, knee boards, inflatable rafts, inner tubes, etc. are commonly used by water sports enthusiasts to travel at a relatively high speed on the surface of a body of water such as a river, a lake, an ocean, etc. Some of these water sport devices, such as inflatable rafts and inner tubes, are pulled over the water surface by a power boat using a towline such as a rope, cable, etc. that is connected between the water sport device and the power boat, while other water sport devices, such as water skis and knee boards, require the operator (i.e., the person using the water sport device) to fasten themselves to the water sport device via a boot, strap, etc. and to grasp a handle attached to one end of a towline that is pulled by a power boat.

The operator of the above-noted commonly available water sport devices may influence or control the lateral movement of some types of water sport devices on the water surface by adjusting the attitude of their body with respect to the orientation of the water sport device, the towline, etc. and/or by changing the heading of the water sport device relative to the heading of the power boat that is pulling the water sport device. For example, by leaning to one side of the water sport device being towed and/or by forcing the heading of the water sport device to rotate toward that same side, the operator may cause the water sport device to move laterally toward that side. Of course, such operator controlled lateral motion of the water sport device works well with water sport devices such as skis and knee boards that have an oblong footprint and relatively flat or thin profiles. On the other hand, the lateral motion of a water sport device such as, for example, an inner tube, may be very difficult, if not impossible, for the operator to control via body orientation and/or orientation of the water sport device with respect to the power boat, the surface of the water, etc. While many of the above-noted towable water sport devices may enable an operator to exert limited control over the manner in which the water sport device travels on the water surface, none of these commonly available water sport devices enables an operator to travel and maneuver below the surface of the water.

A number of technologies are currently available that enable human subsurface travel through a body of water (i.e., underwater travel). For example, snorkeling equipment enables underwater travel for short periods of time and self-contained underwater breathing apparatus (SCUBA), bathyspheres, bathyscaphs, etc. enable humans to travel underwater for extended periods of time. In the case of SCUBA and snorkeling equipment, an operator may also choose to use an aquascooter, which is a self-contained propulsion unit, to increase the speed of their underwater travel. However, none of the above-mentioned currently available subsurface or underwater travel devices are designed to be towed by a vehicle or water craft such as a power boat, sail boat, etc.

One known towable board for underwater swimming and riding on the surface of a body of water is disclosed by U.S. Pat. No. 5,655,939 to Salvadores. The towable board disclosed by Salvadores has a substantially unitary and planar body that includes a pair of wing-shaped lobes, which are symmetrically disposed on opposing sides of a central axis of the towable board. The towable board further includes a pair of fins, each of which extends perpendicularly from a bottom surface of a respective one of the wing-shaped lobes. In operation, the towable board disclosed by Salvadores is pulled by a power boat via a towline while an operator grips the towable board using a pair of slot-shaped openings that extend through the towable board adjacent to the leading edge of each of the wing-shaped lobes. The operator may maneuver the towable board by rotating the board about an axis perpendicular to the water surface, thereby causing the fins to travel through the water at an angle with respect to the heading of the towline, which results in a lateral motion of the towable board in the direction of the rotation. To submerse the towable board or to change the depth at which the towable board is moving, the operator may push downward on the leading edges of the wing-shaped lobes using the slot-shaped openings in the towable board.

SUMMARY OF THE INVENTION

In accordance with one aspect of the invention, a device for use in water surface and subsurface travel may include a towbar having first and second end portions and a first control member rotatably coupled to the towbar adjacent to the first end portion. The first control member may have a first control surface and a second control surface opposite the first control surface. The device may further include a second control member rotatably coupled to the towbar adjacent to the second end portion and spaced from the first control member. The second control member may have a third control surface and a fourth control surface opposite the third control surface. The device may further include first and second grips spaced apart and fixed to the towbar between the first and second control members so that rotation of the first and second grips about a longitudinal axis of the towbar causes the first and second control members to rotate about the longitudinal axis of the towbar. Additionally, a towline connector may be fixed to the towbar between the first and second grips.

In accordance with another aspect of the invention, a device for use in water surface and subsurface travel may include a towbar having a longitudinal axis and a first control member rotatably coupled to the towbar. The first control member may be rotatable about the longitudinal axis of the towbar and the device may include a second control member that is rotatably coupled to the towbar. The second control member may be rotatable about the longitudinal axis of the towbar independently from the first control member. Additionally, the device may include a connector fixed to the towbar for connecting the towbar to a towline.

BRIEF DESCRIPTION OF THE DRAWINGS

FIG. 14 is an exemplary side view of a chassis that may be used with the towable device;

FIG. 15 is an exemplary side view of another chassis that may be used with the towable device;

FIG. 16 is an exemplary plan view of a rudder that may be used with the towable device;

DETAILED DESCRIPTION OF THE PREFERRED EMBODIMENTS

Figure 1:
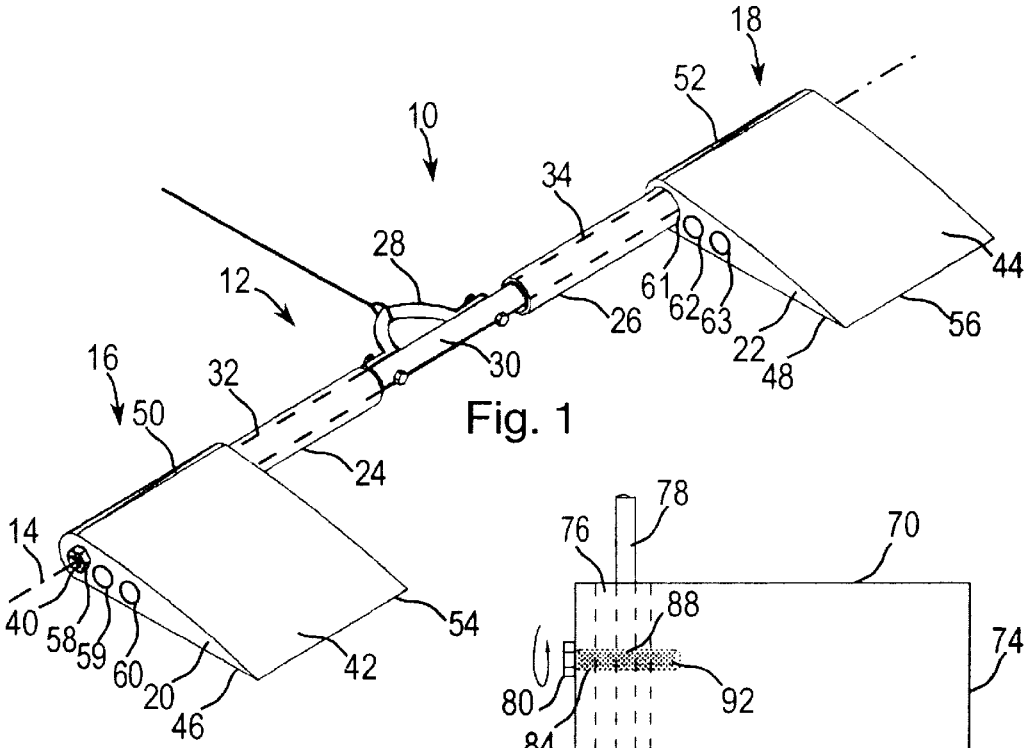
FIG. 1 is an exemplary isometric view of a device for use in human controlled water surface and subsurface travel.

FIG. 1 is an exemplary isometric view of a human controlled towable device 10 that enables a human operator to maneuver on and below the surface of a body of water such as, for example, a river, a lake, an ocean, etc. As shown in FIG. 1, the towable device 10 includes a towbar assembly 12 having a longitudinal axis 14, a first end portion 16 and a second end portion 18. The towbar assembly 12 may also include a first control member 20, a second control member 22, handgrips 24 and 26 and a towline connector 28.

The towbar assembly 12 may include a rigid frame member 30 made of steel, plastic, aluminum or any other suitable material that preferably, but not necessarily, provides a lightweight, corrosion-resistant characteristic. By way of example only, the rigid frame member 30 may be made from aluminum or steel bar stock, thick-walled or thin-walled tubing, etc. to provide sufficient strength and durability for the towable device 10 in a marine or in any other water environment. Additionally, while the towbar assembly 12 is shown in FIG. 1 as having a single rigid frame member 30, a more complex frame having a plurality of interconnected frame members may be used instead to provide a rigid structure to which the control members 20 and 22, the handgrips 24 and 26 and the towline connector 28 may be fixed.

Figure 6:
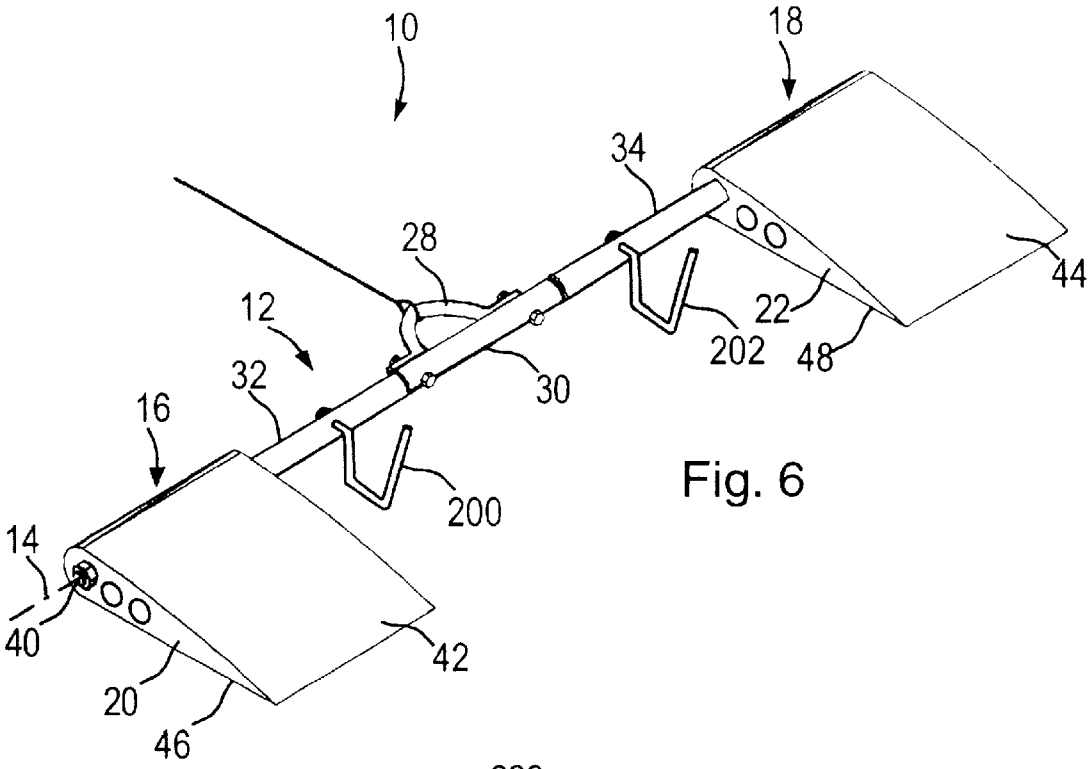
FIG. 6 is an exemplary isometric view illustrating one manner in which handgrips may be used with the towable device.

The towbar assembly 12 may further include shafts or sleeves 32 and 34, which are best seen in FIG. 6, that are rotatably coupled to the rigid frame member 30 using any suitable bearing and retention mechanisms. By way of example only, the sleeves 32 and 34 may be designed as bushings that are rotatably engaged with protrusions or axles (not shown) that are integral with or attached to the rigid frame member 30. The ends of the protrusions or axles may be threaded to accept lock nuts, such as locknut 40, so that the control members 20 and 22, the sleeves 32 and 34 and the handgrips 24 and 26 may be fastened to the towbar assembly 12. Alternatively or additionally, the control members 20 and 22, the handgrips 24 and 26 and the sleeves 32 and 34 may be assembled to the rigid frame member 30 using push nuts, circlips, cotter pins, etc. or any combination thereof. Still further, in the case where the sleeves 32 and 34 form bushings that rotate about respective protrusions from the rigid frame member 30, the sleeves 32 and 34 may be made completely or partially of a self-lubricating material such as, for example, Teflon. In any event, as can be seen from FIG. 1 in conjunction with the above discussion, the handgrips 24 and 26 may be manipulated to cause the control members 20 and 22 to independently rotate about the longitudinal axis 14 of the towbar assembly 12.

As shown in FIG. 1, the control members 20 and 22 have respective upper control surfaces 42 and 44, lower control surfaces 46 and 48, leading edges 50 and 52 and trailing edges 54 and 56. While the control members 20 and 22 are depicted as having an airfoil type profile similar to that of a plane wing, other profiles may be used instead without departing from the scope and the spirit of the invention. The control members 20 and 22 may each include a plurality of respective bores or mounting holes 58–60 and 61–63 that pass through the control members 20 and 22 and that have axes which are substantially parallel to the leading edges 50 and 52 of the control members 20 and 22 and to the longitudinal axis 14 of the towbar assembly 12. As shown in FIG. 1, the mounting hole pairs 58 and 61, 59 and 62, and 60 and 63 may be at different distances from the leading edges 50 and 52. In this manner, the distance between the leading edges 50 and 52 of the control members 20 and 22 may be varied or adjusted in a discrete or stepwise manner to achieve a desirable operational characteristic. For example, increasing the distance between the leading edges 50 and 52 and the longitudinal axis 14 of the towbar assembly 12 may decrease the effort required to rotate the control members 20 and 22 about the longitudinal axis 14 but may also decrease stability of the device 10 while it is being pulled through water. On the other hand, decreasing the distance between the leading edges 50 and 52 and the longitudinal axis 14 of the towbar assembly 12 may increase stability of the device 10 while it is being pulled through water but may also increase the amount of effort or force required to rotate the control members 20 and 22 about the longitudinal axis 14.

It should be recognized that while three mounting holes are shown in each of the control members 20 and 22, more or fewer mounting holes may be used if desired. Additionally, while the mounting holes 58–63 are shown by way of example to have substantially circular outer perimeters, any other perimeter or cross-sectional geometry may be used instead. For example, the mounting holes 58–63 may have generally polygonal or any other non-circular outer perimeter geometry that mates with a similar or identical perimeter geometry of the outer surfaces of the shafts or sleeves 32 and 34 to thereby key or lock the control members 20 and 22 to the sleeves 32 and 34. Of course, in the illustrated embodiments, the inner perimeters of the sleeves 32 and 34 are substantially circular to enable the sleeves 32 and 34 to freely rotate over the bearing surfaces of the protrusions or axles that extend from the rigid frame member 30. Still further, the control members 20 and 22 may be rotatably fixed with respect to the respective sleeves 32 and 34 using any other desired mechanism such as a channel and key arrangement, welding, gluing, a press fit, etc. However, in some cases it may be desirable to use fastening and/or keying mechanisms that enable easy removal and replacement of the control members 20 and 22. For example, a variety of control member designs having different control surface contours, sizes, etc. may be provided so that an operator can selectively attach a particular one of the control member designs to achieve a desired operational characteristic. In general, an operator's height, weight, strength, as well as an operator's desired stability, speed, maneuverability, etc. characteristics may affect the optimal control member selection.

The control members 20 and 22 may be made of any suitable material such as, for example, lightweight plastics and/or metals that are sufficiently strong and durable in a marine or water environment. For example, the control members may be injection molded from a thermoplastic or an elastomeric material, machined from a plastic or a metal material and/or may be fabricated via welding, gluing, using fasteners, etc. using multiple component parts. To minimize weight and cost, the control members 20 and 22 may be partially or completely hollow or may have relieved areas (e.g., pockets, cavities, depressions, etc.) distributed over the control surfaces 42–48.

The handgrips 24 and 26 are fixed to the outer surfaces of the respective sleeves 32 and 34 so that rotation of the handgrips 24 and 26 about the longitudinal axis 14 causes the sleeves 32 and 34 and the control members 20 and 22 to rotate about the longitudinal axis 14. Of course, because the control members 20 and 22 are independently rotatable, one of the handgrips 24 and 26 may be rotated in one direction about the longitudinal axis 14 while the other one of the handgrips 24 and 26 may be rotated in another direction about the longitudinal axis 14. The handgrips 24 and 26 may be made of any suitable material such as, for example, a metal, which may include knurled potions that facilitate griping by an operator, a foam or other spongy material that can be easily gripped by an operator, a plastic material, etc. As shown in FIG. 1, the handgrips 24 and 26 may be press fit, glued, or fixed in any other desired manner to the sleeves 32 and 34. Still further, while the handgrips 24 and 26 are depicted as being separate components that are fixed to the sleeves 32 and 34, the handgrips 24 and 26 may instead be integrally formed with the sleeves 32 and 34. For example, the sleeves 32 and 34 may be provided with larger diameter portions, knurled portions, or any other dimensions or features that facilitate an operator's rotating of the control members 20 and 22. The towline connector 28 may be a U-shaped or a V-shaped component that is fixed to the rigid frame member 30 via bolts, screws and/or welds and is preferably, but not necessarily, disposed substantially centrally between the control members 20 and 22 and the handgrips 24 and 26.

In operation, the towable device 10 may be used in a body of water such as a river, a lake, an ocean, etc. and may be connected to a tow vehicle such as, for example, a power boat, a sail boat, a row boat, etc. via a towline. An operator may enter the body of water and grasp the handgrips 24 and 26 while lying in a prone or face-down position in the water. As the towable device 10 and its operator are pulled by the tow vehicle through the water, the operator may maneuver through the water by rotating the control members 20 and 22 via the handgrips 24 and 26 and/or by manipulating their body orientation in the water and with respect to the towable device 10. For example, rotating the trailing edges 54 and 56 of both control members 20 and 22 upward and toward the towline connector 28 (and the towline) causes the towable device 10 to submerge or to dive in the water. On the other hand, rotating the control members 20 and 22 so that the trailing edges 54 and 56 rotate downward causing the towable device 10 and its operator to climb toward the water surface. Still further, rotating the control members 20 and 22 in opposing directions causes the towable device 10 and its operator to travel in a spiraling manner through the water. Still further, by changing the rotations of the control members 20 and 22 so that both of the trailing edges 54 and 56 are alternately rotated upward and downward at the same time, an operator may cause the towable device 10 to porpoise (i.e., to alternately jump out of and dive into the water). Of course, an operator may alternatively or additionally manipulate their body by, for example, leaning to one side or the other, changing the orientation of their legs or arms, etc. to maneuver through the water. Additionally, mechanical stops may be provided within the towable device 10 to limit the angle through which the control members 20 and 22 may be rotated. In this manner, stalling, dangerous maneuvers, etc. may be minimized or prevented.

Preferably, but not necessarily, the towable device 10 is made of one or more materials and is configured so that the towable device 10 floats in water when in a static or rest condition, thereby simplifying an operator's effort to mount or grab the towable device 10 and/or simplifying recovery of the towable device 10 in the event that an operator loses their grip during use and becomes separated from the device 10.

Figure 2:
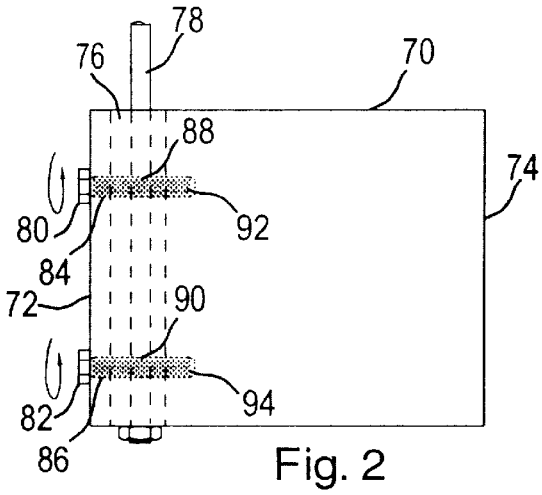
FIG. 2 is an exemplary plan view of one manner in which control members may be adjustably fixed to the towable device.

FIG. 2 is an exemplary plan view of an alternative control member design that may be used with the towable device described herein to enable a continuous adjustment of the distance between the leading edge of the control member and the rotational axis of the control member. As shown in FIG. 2, a control member 70 having a leading edge 72 and a trailing edge 74 includes a passage 76 therethrough that is substantially parallel to the leading edge 72 and to the trailing edge 74. The passage 76 may have an oblong cross section such as, for example, an oval-shaped or rectangular cross section. However, any other cross section may be used instead. A rotatable shaft or sleeve 78, which may be similar or identical to the shafts or sleeves 32 and 34 shown in FIG. 1, traverses the passage 76. Threaded adjusting screws 80 and 82 pass through respective openings 84 and 86 in the control member 70 through threaded bores 88 and 90 in the sleeve 78 and into blind holes 92 and 94. Thus, by rotating the screws 80 and 82 either clockwise or counterclockwise, the sleeve 78 may be moved toward or away from the leading edge 72 of the control member 70.

Figure 3:
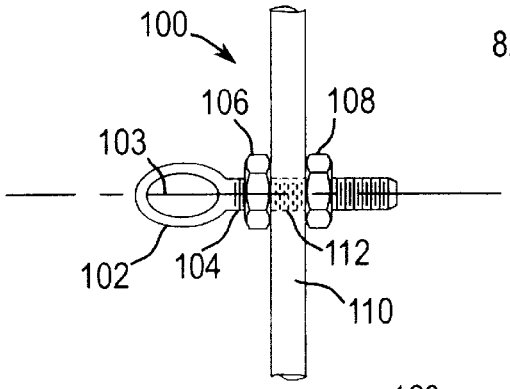
FIG. 3 is an exemplary plan view of an adjustable towline connector that may be used with the towable device.

FIG. 3 is an exemplary plan view of an adjustable towline connector 100 that may be used with the towable device described herein. The towline connector 100 shown in FIG. 3 includes an eye bolt 102 having a towing eye 103, a threaded portion 104 and a pair of locknuts 106 and 108. The threaded portion 104 of the eye bolt 102 passes through a rigid frame member 110, which may be similar or identical to the rigid frame member 30 shown in FIG. 1, via a bore 112. As can be seen from FIG. 3, the distance between the towing eye 103 and the rigid frame member 110 may be set to any desired distance that permits the locknuts 106 and 108 to be tightened to lock or fix the position of the towing eye 103. Thus, an operator may vary the position of the towing eye 103 to achieve a desired feel or operational characteristic of the towable device described herein.

Figure 4:
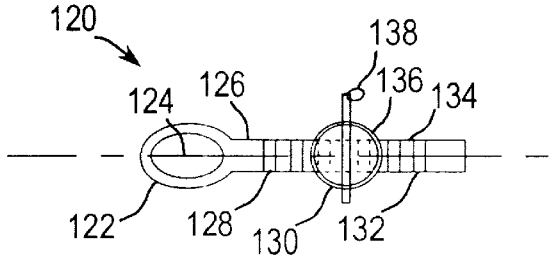
FIG. 4 is an exemplary sectional view of another adjustable towline connector that may be used with the towable device.

FIG. 4 is an exemplary sectional view of another adjustable towline connector 120 that may be used with the towable device described herein. The towline connector 120 includes an eye bolt 122 having a towing eye portion 124 and a shaft portion 126 which has a plurality of bores or holes 128–132 therethrough. The shaft portion 126 of the connector 120 passes through a bore 134 in a rigid frame member 136, which may be similar or identical to the frame member 30 shown in FIG. 1, and a pin 138 passes through the frame member 136 and one of the plurality of holes 128–132 to fix the connector 120 to the frame member 136. As can be seen in FIG. 4, the distance between the towing eye 124 and the frame member 136 may be varied in discrete amounts by fixing the eye bolt 122 to the frame member 136 using different ones of the holes 128–132. For example, when the hole 128 is used, the towing eye 124 is nearer to the frame member 136 than when the hole 132 is used.

Figure 5A:
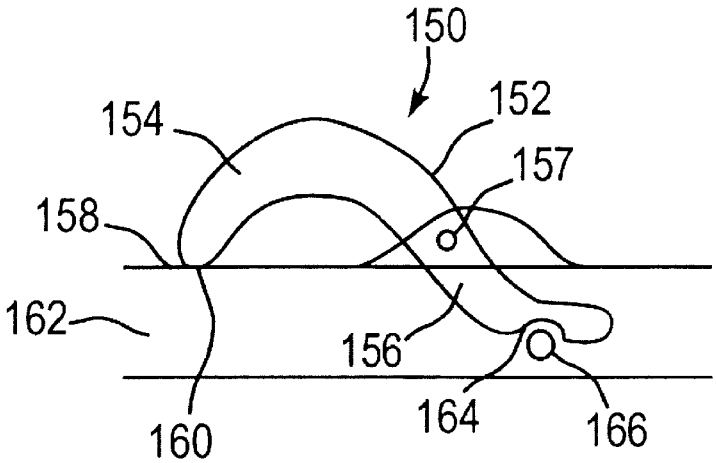
FIG. 5*a* is an exemplary side view of yet another towline connector that enables rapid disconnection of a towline and which may be used with the towable device.
Figure 5B:
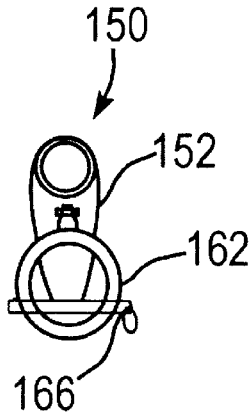
FIG. 5*b* is a front sectional view of the towline connector shown in FIG. 5*a*.

FIG. 5*a* is an exemplary side view of yet another towline connector 150 that enables rapid disconnection of a towline and which may be used with the towable device described herein, and FIG. 5*b* is a front sectional view of the towline connector 150 shown in FIG. 5*a*. The towline connector 150 includes a curved arm 152 having a first arm portion 154 and a second arm portion 156 that rotate about a pivot 157. The first arm portion 154 has a finger portion 158 that stops against a surface 160 of a rigid frame member 162 that may, for example, be a part of the rigid frame member 30(FIG. 1) of the towable device described herein. The second arm portion 156 includes a detent 164 for receiving a pin 166 as shown in FIGS. 5*a* and 5*b*.

In operation, the pin 166 may be removed to enable the first arm portion 154 and the finger portion 158 to be rotated away from the surface 160 of the frame member 162. A towline loop, eye, etc. may then be passed over the first arm portion 154 and the first arm portion 154 may be rotated so that the finger 158 contacts the surface 160 so that the pin 166 may be inserted into the frame member 162 as shown in FIGS. 5*a* and 5*b* to lock the towline connector 150 in position. In use, an operator may remove the pin 166 from the frame member 162 to unlock the connector 150 so that the towline may be pulled free from the connector 150. In this manner, the towable device described herein may be quickly released from the tow vehicle in, for example, a dangerous or panic situation.

FIG. 6 is an exemplary isometric view generally illustrating one manner in which handgrips 200 and 202 may be used with the towable device described herein. As shown in FIG. 6, the handgrips 200 and 202 are fixed to respective ones of the rotatable shafts or sleeves 32 and 34 so that rotation of the handgrips 200 and 202 about the longitudinal axis 14 of the towbar assembly 12 causes the control members 20 and 22 to rotate about the longitudinal axis 14. Generally speaking, the handgrips 200 and 202 may be fixed to the sleeves 32 and 34 of the towbar assembly 12 via bores through the sleeves 32 and 34 that are preferably, but not necessarily, substantially transverse to the longitudinal axis 14 of the towbar assembly 12.

Figure 7:
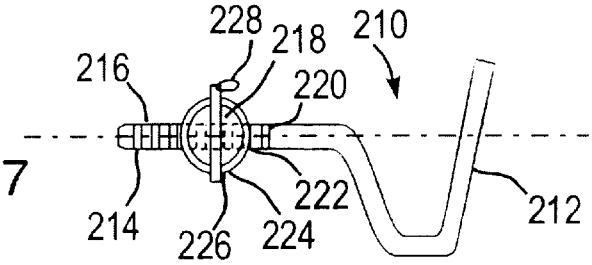
FIGS. 7–11 are exemplary views of alternative handgrip designs that may be used with the towable device.

FIGS. 7–11 are exemplary views of alternative handgrip designs that may be used with the towable device described herein. In particular, FIG. 7 is an exemplary side view, partially in section, of a grip or handgrip 210 that may be used with the towable device described herein. The handgrip 210 includes an elongated griping portion 212 and a shaft portion 214 that is spaced from the elongated griping portion 212. The shaft portion 214 includes a plurality of bores 216–220 that enable the elongated griping portion 212 to be fixed at one of several possible distances from the longitudinal axis 14 of the towbar assembly described herein. As shown in FIG. 7, the shaft portion 214 of the handgrip 210 may be inserted into a bore 222 that passes through a rotatable shaft or sleeve 224, which may be similar or identical to the shafts or sleeves 32 and 34 shown in FIG. 1. The shaft or sleeve 224 may include another bore 226, which is substantially transverse to the bore 222, for receiving a pin 228 that locks the handgrip 210 to the rotatable sleeve 224. Thus, when the bore 226 is substantially coaxially aligned with one of the plurality of holes 216–220, the pin 228 may be used to fix or to lock the handgrip 210 to the sleeve 224.

Figure 8:
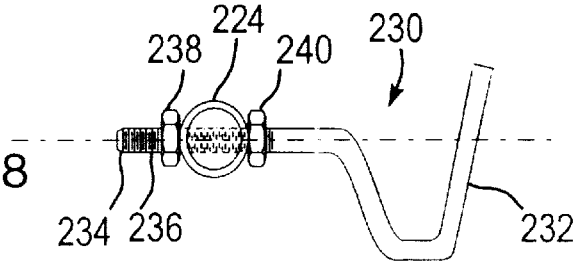

FIG. 8 is an exemplary side view, partially in section, of another grip or handgrip 230 that may be used with the towable device described herein. The handgrip 230 may include an elongated griping portion 232 and a shaft portion 234 that includes a threaded portion 236. The handgrip 230 may be fixed to the shaft or sleeve 224 by tightening lock nuts 238 and 240 against the sleeve 224. In contrast to the handgrip 210 shown in FIG. 7, the distance between the elongated griping portion 232 and the axis of rotation of the sleeve 224 may be adjusted in a continuous rather than a discrete or stepped manner.

Figure 9:
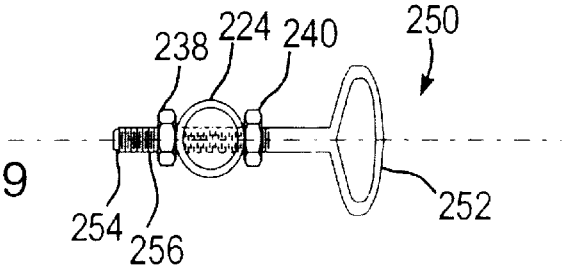

FIG. 9 is an exemplary side view, partially in section, of still another handgrip 250 that may be used with the towable device described herein. The handgrip 250 includes an elongated griping portion 252 and a shaft portion 254 having a threaded portion 256. The handgrip 250 shown in FIG. 9 may be fixed to the shaft or sleeve 224 using the locknuts 238 and 240.

Figure 10:
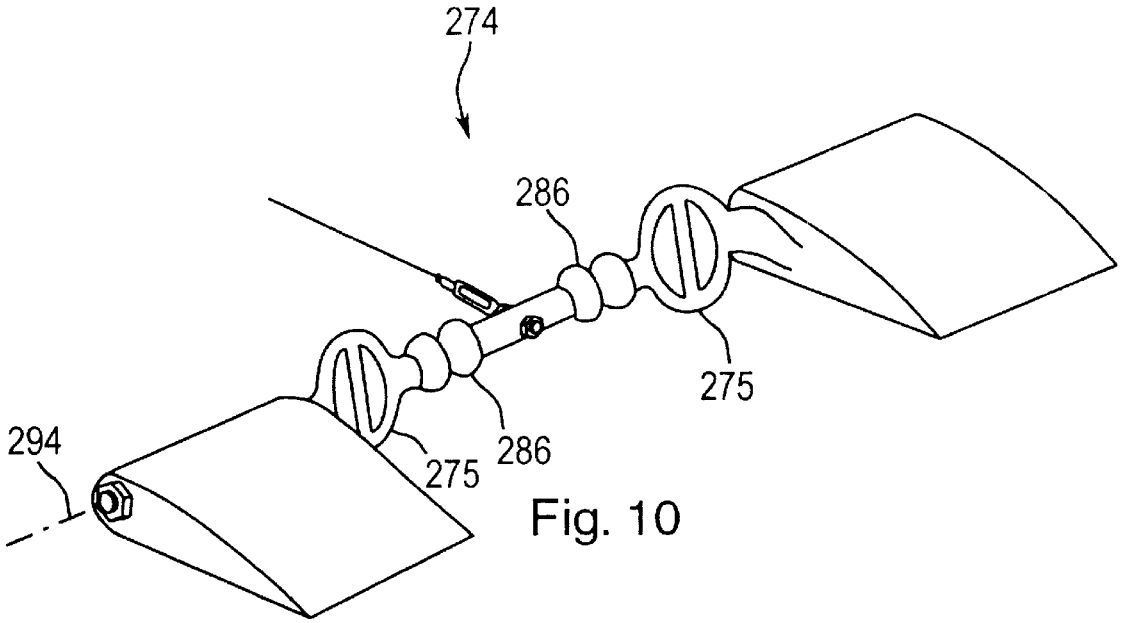
Figure 11:
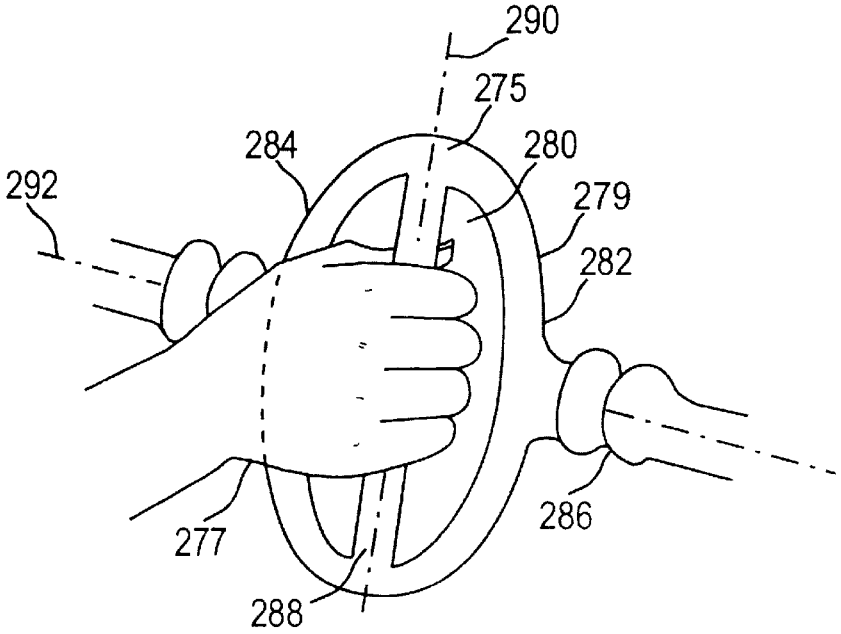

FIG. 10 is an exemplary isometric view of a towable device 274 that uses yet another type of handgrip 275, and FIG. 11 is an enlarged diagrammatic view of the handgrip 275 shown in FIG. 10 that illustrates the manner in which an operator's hand 277 may grasp the handgrip 275. As best shown in FIG. 11, the handgrip 275 has an outer perimeter 279 that defines an opening 280 and which has a first side 282 and a second opposing side 284. The first and second sides 282 and 284 are preferably, but not necessarily, integral with a rotatable shaft or sleeve 286, which may be similar or identical to the shafts or sleeves 32 and 34 shown in FIG. 1. The handgrip 275 may also include an elongated griping portion 288 that traverses the opening 280 and which has a longitudinal axis 290 that forms a non-zero angle with respect to a longitudinal axis 292 of the rotatable shaft or sleeve 286 and, thus, forms a non-zero angle with respect to a longitudinal axis 294 (FIG. 10) of the towable device 274.

Figure 12A:
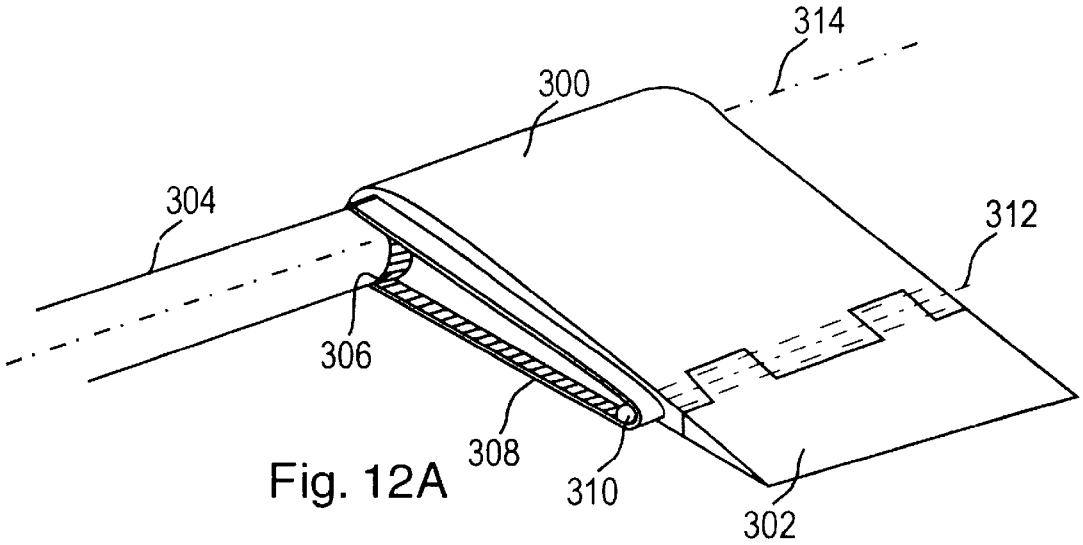
FIG. 12A is an exemplary isometric view of a control member having a movable trailing edge that may be used with the towable device.

FIG. 12A is an exemplary isometric view of a control member 300 having a movable trailing edge 302 that may be used with the towable device described herein. A rotatable shaft or sleeve 304 may include a toothed portion 306 that drives a chain or toothed belt 308 that, in turn, may be used to rotate a pulley or gear 310 to cause the trailing edge 302 to rotate or pivot about an axis 312, which may be substantially parallel to a longitudinal axis 314 of the shaft or sleeve 304. Although FIG. 12A illustrates the movement of the trailing edge 302 as being carried out using a belt or a chain, any other suitable drive mechanism may be used instead, such as, for example, direct drive gearing (i.e., a transmission), push rods and lever arms, fluid or hydraulic coupling, etc.

Figure 12B:
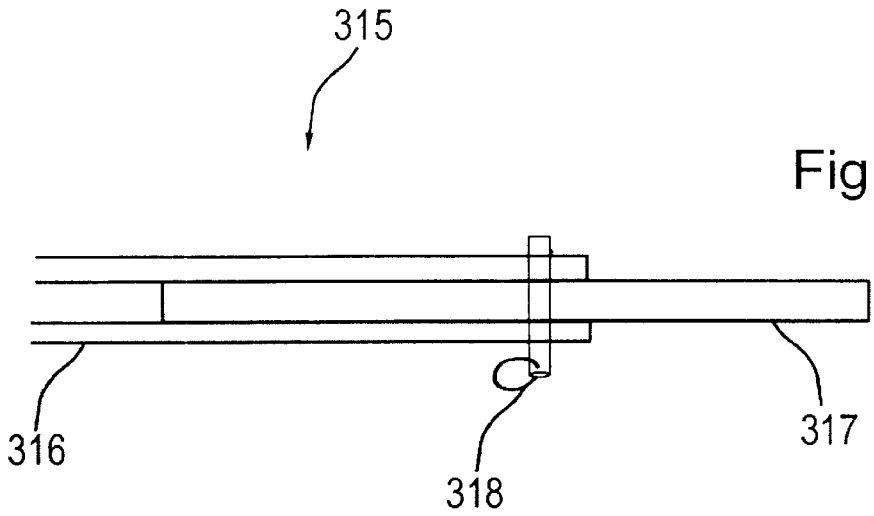
FIG. 12B is an exemplary front view of a control member that has a variable control surface area.

FIG. 12B is an exemplary front view of a control member 315 having a variable control surface area that may be used with the towable device described herein. The control member 315 includes an outer portion or panel 316 and an inner portion or panel 317 that is slidingly engaged with the outer panel 316. Thus, the inner panel 317 may be telescopically extended to increase the exposed surface area of the control member 315 or, alternatively, the inner panel 317 may be telescopically compressed with respect to the outer panel 316 to decrease the exposed surface area of the control member 315. The control member may further include a pin 318 for locking the relative positions of the inner and outer panels 316 and 317. The inner panel 317 may be shaped so that variation of the position of the inner panel 317 with respect to the outer panel 316 results in a continuous or, alternatively, a stepped, variation of the exposed surface area of the control member 315.

Figure 12C:
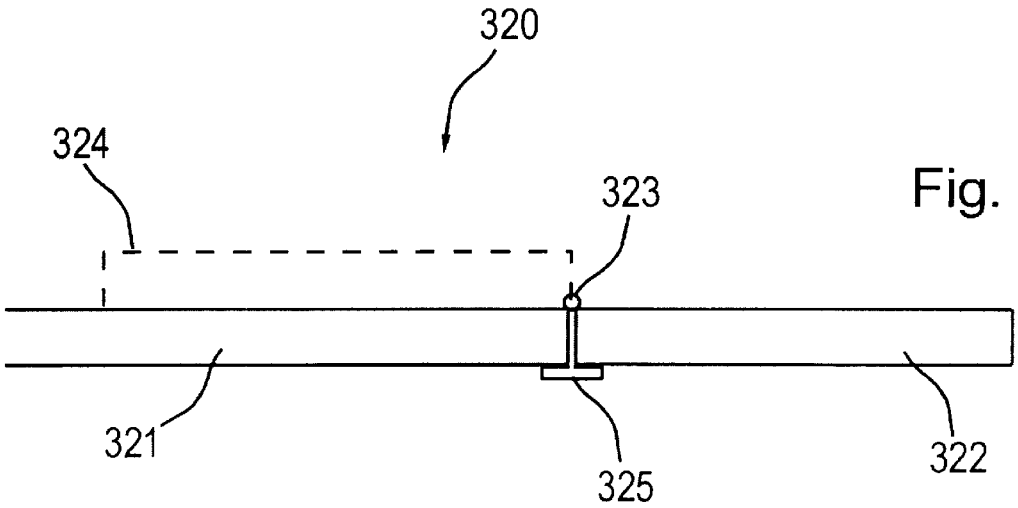
FIG. 12C is an exemplary front view of another control member that has a variable control surface area.

FIG. 12C is an exemplary front view of another control member 320 having a variable control surface area that may be used with the towable device described herein. The control member 320 includes a primary portion or panel 321 and an extension portion or panel 322 that is coupled to the primary panel 321 via a hinge 323. The extension panel 322 may be folded against the primary panel 321 as indicated by the dashed lines 324 to reduce the effective surface area of the control member 320. The control member 320 may further include a locking mechanism 325 that locks the extension panel 322 in an extended or unfolded position as shown in FIG. 12C. The locking mechanism 325 may be implemented using a U-shaped pin that may be pressed into bores that extend partially or completely through adjacent portions of the primary and extension panels 321 and 322.

In operation, a control member having a variable control surface area, such as those exemplary control members shown in FIGS. 12B and 12C, provides several advantages. For example, the control surface area may be increased during relatively low speed operation to increase or improve maneuverability. Conversely, the control surface area may be decreased during relatively high speed operation to reduce drag and stress on the control member. Additionally, the retracted, folded or minimal area condition for the control members may be used to reduce the overall footprint of the towable device to thereby facilitate storage of the device within a relatively small area or volume.

Figure 13:
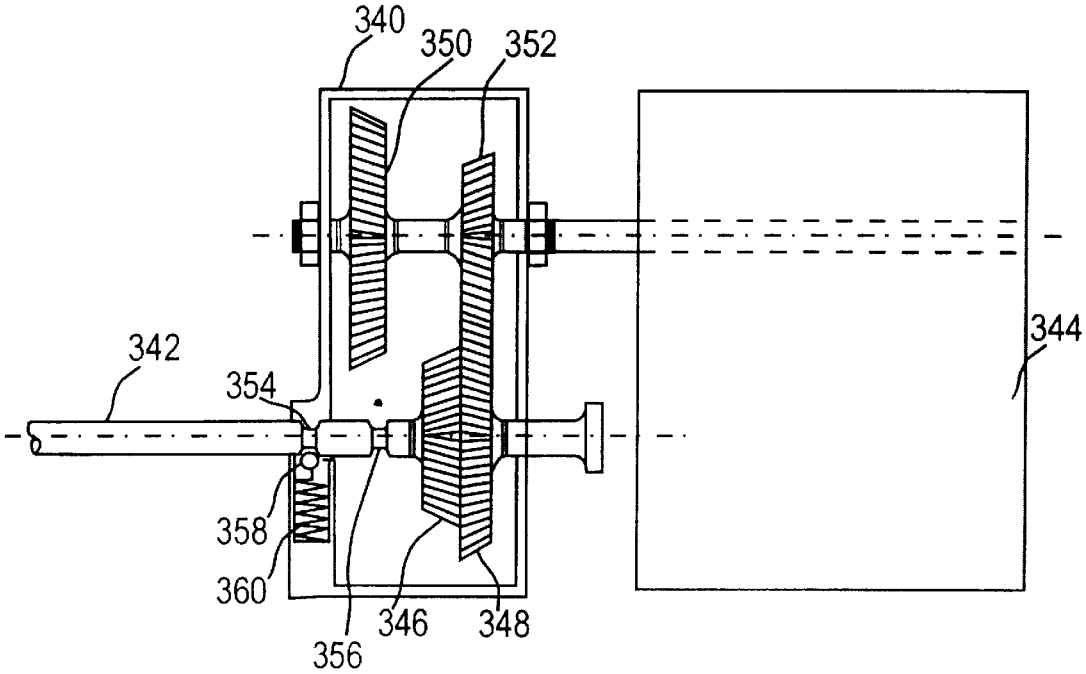
FIG. 13 is an exemplary plan view, partially in section, of a gear set that may be interposed between the handgrips and the control members of the towable device.

FIG. 13 is an exemplary plan view, partially in section, of a dual ratio (i.e., two speed) transmission or gear set 340 that may be interposed between the handgrips and the control members of the towable device described herein. As shown in FIG. 13, a rotatable shaft or sleeve 342, which may be rotated by the operator via a handgrip such as those described herein, or in any other manner, may be rotated to cause a control member 344 to rotate. By way of example only, the gear set 340 may include input gears 346 and 348 that may be positioned to drive respective output gears 350 and 352. The shaft 342 may include detent grooves 354 and 356 for receiving locking ball 358, which may be biased by a spring 360 against the shaft or sleeve 342. Thus, as can be seen in FIG. 13, when the shaft or sleeve 342 is positioned so that the locking ball 358 lies within the groove 354, input gear 348 drives output gear 352, resulting in a first drive ratio. On the other hand, when the shaft 342 is positioned so that the locking ball 358 lies within the groove 356, the input gear 346 drives the output gear 350, resulting a second drive ratio. It should be recognized that a gear set or transmission such as the gear set 340 shown in FIG. 13 may be interposed between each handgrip or rotatable shaft or sleeve and the control members of the towable device described herein.

FIG. 14 is an exemplary side view of a chassis 400 that may be used with the towable device described herein. For purposes of clarity of description (i.e., to show the relationships between the various components of the towable device described herein and the operator), the chassis 400 is depicted as being made of a translucent or opaque material. However, any suitable plastic, elastomeric material, metal, etc. may be used to fabricate the chassis 400. As shown in FIG. 14, the chassis 400 may include a fairing portion 402 that deflects water away from an operator 404 who is lying in a prone position while grasping the handgrips, such as the handgrips 24 and 26 shown in FIG. 1, of the towable device described herein. The chassis 400 is disposed between the control members of the towable device, (one of the control members is shown at reference numeral 406) and may have any suitable shape such as, for example a wedge, a partial ellipsoid, etc. A towline 408 extends through a front portion 410 of the chassis 400. As is also shown in FIG. 14, the operator 404 may wear a helmet or any other protective headgear 412 and may wear a face mask or goggles 414 to provide further protection and/or to improve visibility while being pulled through the water. In the case where the chassis 400 is made from a material that provides only limited or no visibility (i.e., a material that does not allow light to pass through it) a viewing window 415 may be provided.

FIG. 15 is an exemplary side view of another chassis 418 that may be used with the towable device described herein. The chassis 418 is similar to the chassis 400 shown in FIG. 14 except that the chassis 418 shown in FIG. 15 includes an elongated lower portion 420 and a rudder 422 that pivots about a transverse axis of the chassis 418. An exemplary plan view of the rudder 422 is shown in FIG. 16. In operation, the elevation of the rudder 422 may be manipulated by the operator's feet or legs to facilitate more dramatic vertical maneuvers such as, for example, porpoising and the like. Additionally, mechanical stops (not shown) may be provided as an integral feature of the rudder 422 or as a separate feature or structure of the towable device that protect an operator's knees from hyperextension.

Figure 17:
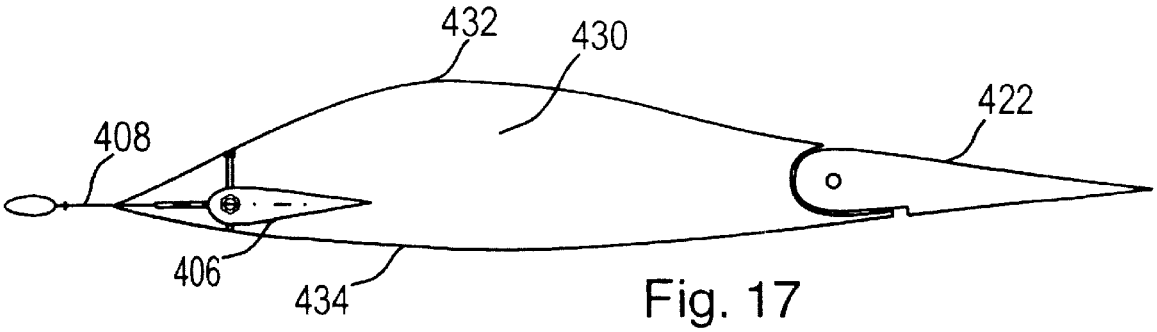
FIG. 17 is an exemplary side view of yet another chassis that may be used with the towable device.

FIG. 17 is an exemplary side view of yet another chassis 430 that may be used with the towable device described herein. As shown in FIG. 17, the chassis 430 has an elongated upper portion 432 and an elongated lower portion 434 so that an operator may be substantially encapsulated by the chassis 430. The chassis 430 depicted in FIG. 17 provides increased isolation of the operator from dynamic water pressures, thereby enabling the operator to perform maneuvers (e.g., porpoising) at greater speeds and/or in greater comfort.

Figure 18:
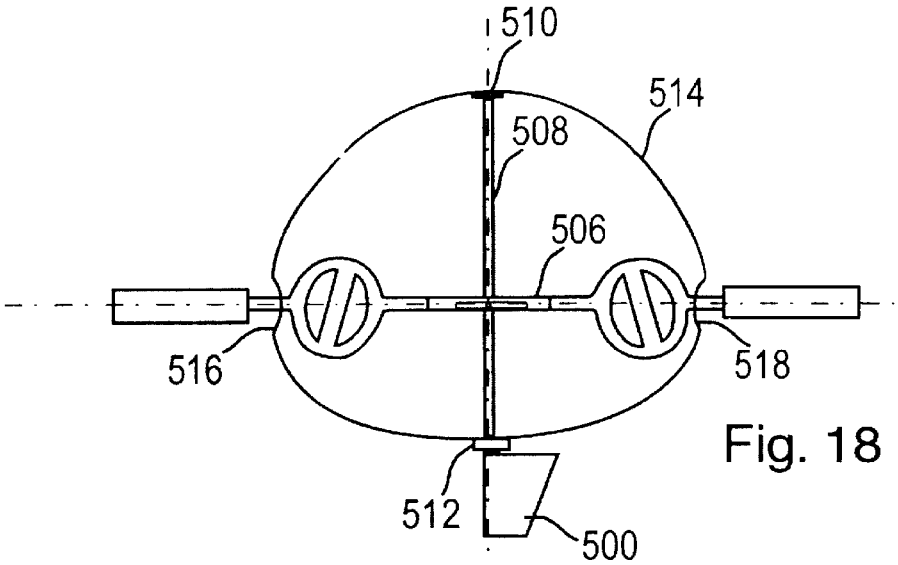
FIG. 18 is an exemplary front view, partially in section, of another rudder that may be used with the towable device.
Figure 19:
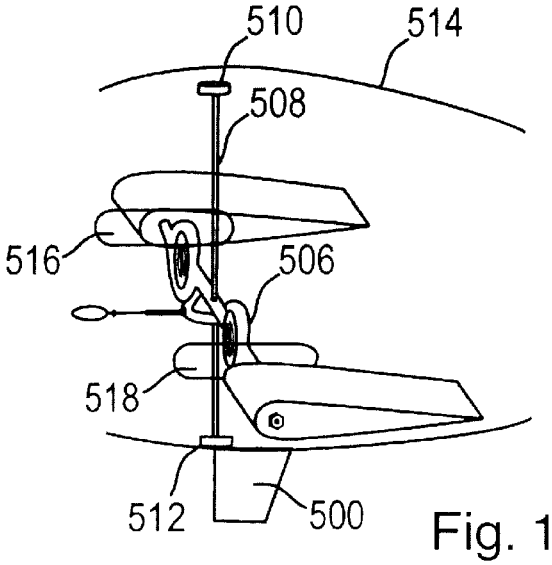
FIG. 19 is an exemplary side view illustrating one manner in which the towable device chassis may provide openings to permit movement of the towbar relative the chassis.

FIG. 18 is an exemplary front view, partially in section, of another rudder 500 that may be used with the towable device described herein to facilitate lateral movements of the towable device. A towbar assembly 506 may be fixed to a vertical shaft 508 that may be rotated in bearings 510 and 512 about the longitudinal axis of the vertical shaft 508, which is substantially perpendicular to the longitudinal axis of the towbar assembly 506. A chassis 514 associated with the towable device shown in FIG. 18 may also include slots or openings 516 and 518 that facilitate rotation of the towbar assembly 506 about the longitudinal axis of the shaft 508 to enable movement of the rudder 500. The relationship between the slots or openings 516 and 518 and the towbar assembly 506 is shown in FIG. 19.

Figure 20:
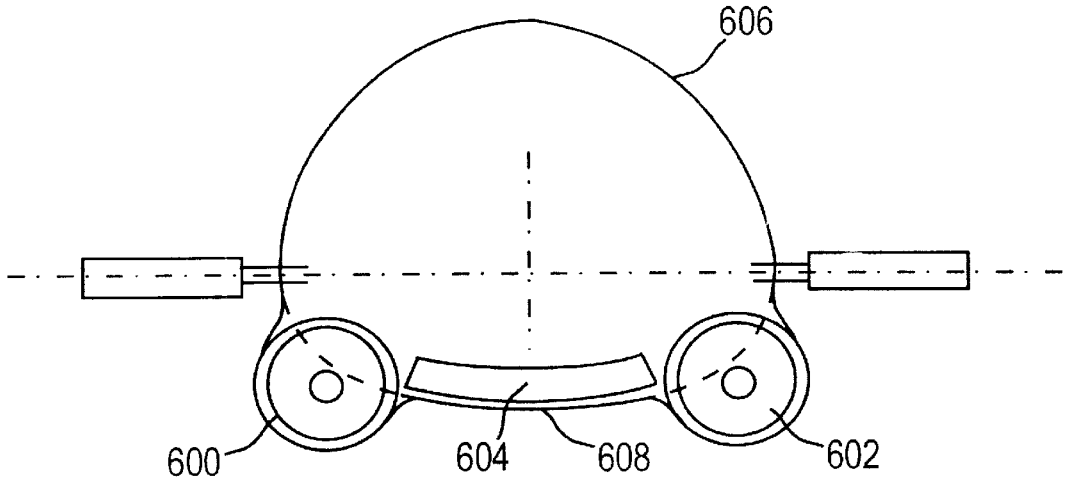
FIG. 20 is an exemplary front sectional view illustrating one manner in which air tanks and a flotation pad may be fixed to the chassis of the towable device.

FIG. 20 is an exemplary front sectional view illustrating one manner in which air storage tanks 600 and 602 and a flotation pad 604 may be fixed to a chassis 606 of the towable device described herein. The air storage tanks 600 and 602 may be conventional SCUBA tanks or any other air storage tanks that are capable of storing air for use by an operator. While two air storage tanks are shown in FIG. 20, more or fewer tanks may used as needed. The floatation pad 604 is preferably fixed to a lower portion 608 of the chassis 606 so that the pad 604 lies between an operator and the lower portion 608 of the chassis 606, thereby providing improved comfort for the operator. The flotation pad 604 may be configured so that the towable device described herein remains buoyant when occupied by a typical human operator. In other words, the pad 604 provides sufficient buoyant force to keep the occupied towable device afloat, at least when the towable device is not being pulled through the water. By way of example, the pad 604 may be made of styrofoam or any other foam that provides buoyancy. Alternatively or additionally, buoyant force may be provided using one or more substantially hollow gas-filled structures.

Figure 21:
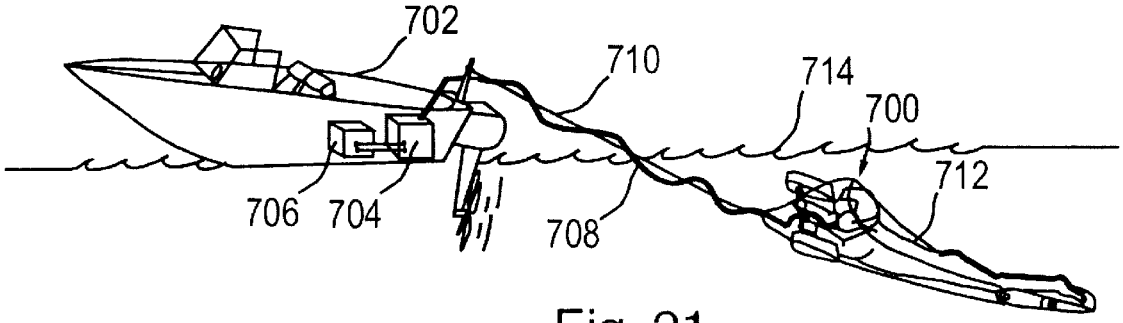
FIG. 21 is an exemplary diagrammatic view illustrating one manner in which air may be provided to an operator of the towable device from a remote location.

FIG. 21 is an exemplary diagrammatic view illustrating one manner in which air may be provided to an operator of a towable device 700 from a remote location. As shown in FIG. 21, a tow vehicle 702, which is depicted by way of example only as being a power boat, includes an air compressor 704 and a power source 706 for the air compressor 704. A compressed air supply line 708 may wrap around a towline 710 and may provide a supply of breathable compressed air to an operator 712 submerged below a water surface 714. Thus, the operator 712 does not necessarily have to surface to breath and, as a result, may enjoy extended subsurface or underwater operation. The operator 712 may draw air from the air supply line 708 using conventional SCUBA breathing apparatus or any other suitable breathing apparatus.

Figure 22:
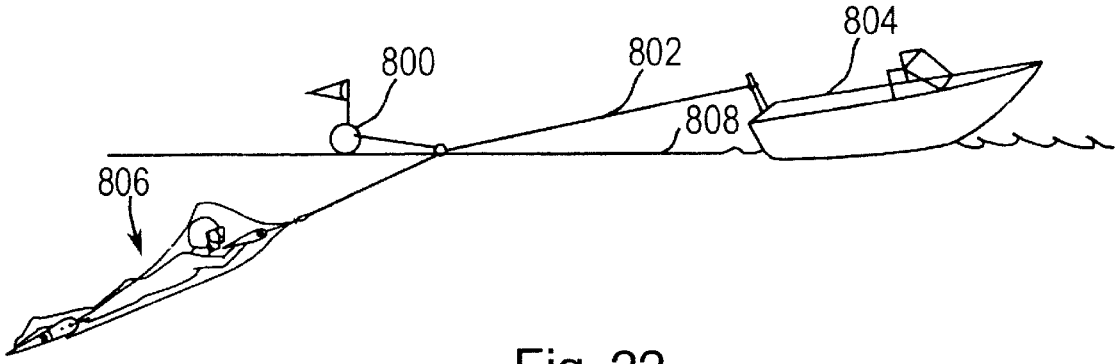
FIG. 22 is an exemplary diagrammatic view of a buoyant indicator that may be used with the towable device.

FIG. 22 is an exemplary diagrammatic view of a buoyant indicator 800 that may be used with the towable device described herein. The indicator 800 may be coupled to a towline 802 so that as a tow vehicle 804 pulls an operator 806 below a water surface 808, the buoyant indicator 800 moves along the towline 802 so that the buoyant indicator 800 remains floating on the water surface 808 and so that other boaters, skiers, etc., the driver of the tow vehicle 804 and any other persons in the vicinity may be warned of the approximate location of the submerged operator 806.

Figure 23:
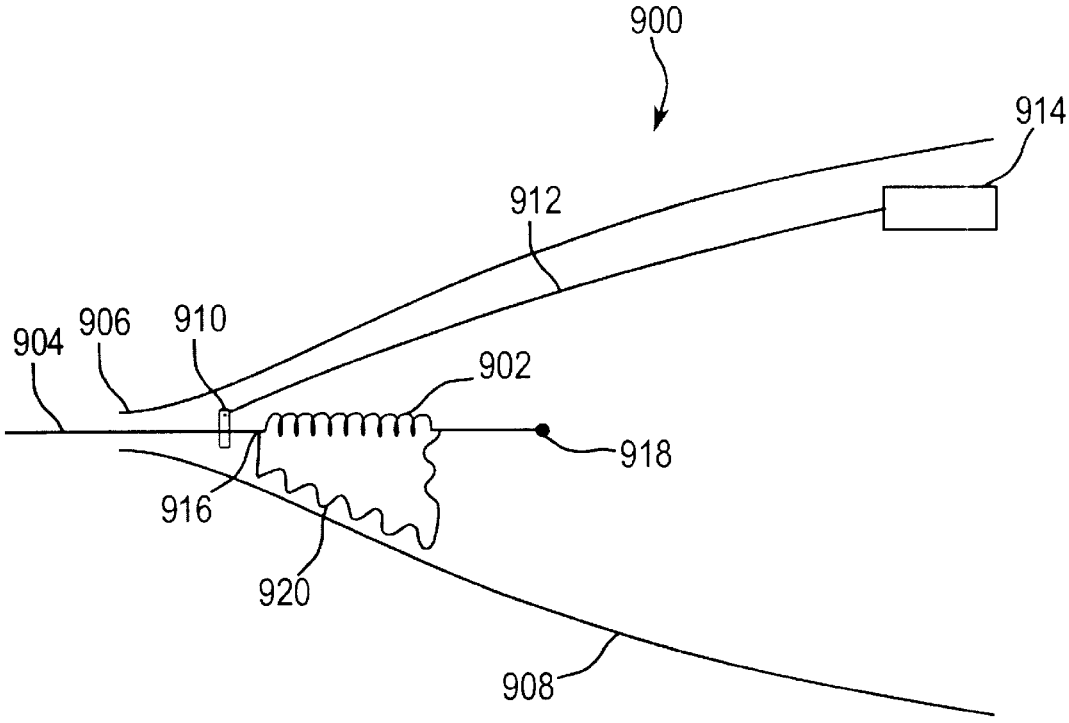
FIG. 23 is an exemplary diagrammatic view of a towline mechanism that may be used with the towable device.

FIG. 23 is an exemplary diagrammatic view of a towline mechanism 900 that may be used with the towable device described herein. The towline mechanism 900 includes an elastic member 902 that is coupled to a towline 904 that extends through a nose or front portion 906 of a towable device chassis 908 such as, for example, those described herein. The towline mechanism 900 may further include a latch 910 that is fixed to the chassis 908 and releasably coupled to the towline 904 and which may be actuated or controlled via a release cable 912 and a release switch 914. As shown in FIG. 23, one end 916 of the elastic member 902 may be coupled to the towline 904 adjacent to the latch 910, while another end 918 of the member 902 may be fixed to the chassis 908. The elastic member 902 may be implemented using, for example, a stretchable rope, an expansion spring, or any other suitable device or component that elongates in response to the towline 904 being pulled by a tow vehicle. Additionally, the elastic member 902 may be made from a plastic, a corrosion resistant metal, or any other material suited for use in a water or marine environment.

In operation, with the latch 910 engaged (i.e., coupled to the towline 904), the towable device is pulled by a tow vehicle from a point coincident with the latch 910. On the other hand, if an operator activates the release switch 914, the release cable 912 actuates the latch 910 to release the towline 904, which causes the elastic member 902 to elongate and increases the effective length of the towline 904. With the latch 910 released, the towable device is pulled by the tow vehicle from a point coincident with the end 918 of the elastic member 902. To limit extension of the towline 904 or to prevent the elastic member 902 from becoming overextended, a safety loop 920 may be fixed to the ends 916 and 918 of the elastic member 902. The safety loop 902 is preferably, but not necessarily, made from a relatively inelastic material such as, for example, a low-stretch rope, a plastic or metal strap, a braided metal cable, or any other suitable material, device or component.

The towline mechanism 900 may be used to dynamically provide additional towline length to facilitate increased airborne time during, for example, porpoising maneuvers. Of course, the elastic action of the member 902 facilitates the subsequent retraction of the towline 904 and a re-latching of the towline 904 in the original shortened condition. Still further, the elastic action of the member 902 provides a shock dampening characteristic, especially following an airborne condition during which the tow vehicle has maintained or increased its speed, the speed of the towable device has decreased and the towline 904 has become slack.

Figure 24:
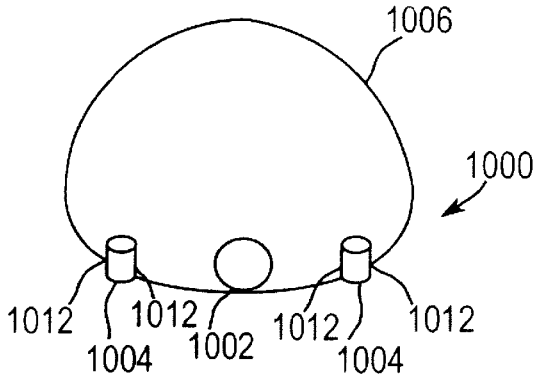
FIGS. 24 and 25 are exemplary front and side diagrammatic views, respectively, of a propulsion system that may be used with the towable device.
Figure 25:
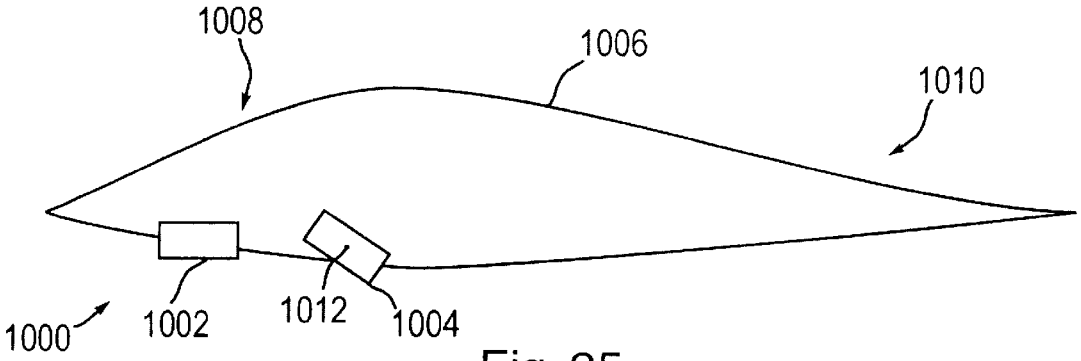

FIGS. 24 and 25 are exemplary front and side diagrammatic views, respectively, of a propulsion system 1000 that may be used with the towable device described herein. The propulsion system 1000 may include a water turbine 1002 and one or more nozzles 1004, all of which may be fixed to a chassis 1006 of the towable device. Preferably, but not necessarily, the water turbine 1002 is approximately centrally located across the breadth of the chassis 1006 and may be located closer to a front portion 1008 of the chassis 1006. In any event, the water turbine 1002 may be fixed to the chassis 1006 to facilitate the intake of water as the towable device is towed through a body of water. Additionally, the location of the nozzles 1004 may be selected to achieve a desired operational characteristic. For example, locating the nozzles 1004 nearer to a rear portion 1010 of the chassis 1006 may increase maneuverability, whereas locating the nozzles 1004 nearer to the front portion 1008 of the chassis 1006 may result in greater stability but decreased maneuverability. Furthermore, the nozzles 1004 may be mounted on pivots 1012 that allow the nozzles 1004 to rotate about a transverse axis of the chassis 1006. In this manner, the nozzles 1004 may be oriented to provide thrust in a desired direction to achieve a desired operational characteristic.

Figure 26:
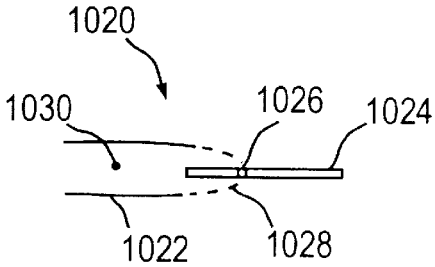
FIG. 26 is an exemplary sectional side view of a nozzle assembly that may be used with the towable device propulsion system.

FIG. 26 is an exemplary sectional side view of a nozzle assembly 1020 that may be used with the towable device propulsion system described herein. The nozzle assembly 1020 includes a nozzle body 1022 and a controllable baffle 1024 that may be rotated about a pivot 1026, which is adjacent to an exit 1028 of the nozzle assembly 1020. Generally speaking, the position of the controllable baffle 1024 may be varied as desired to change the thrust vector (i.e., the direction or trajectory in which water exits the nozzle body 1022) of the nozzle assembly 1020. The baffle 1024 preferably, but not necessarily, has an oblong footprint and is relatively thin and flat. Additionally, the baffle 1024 may be adjustably fixed in a desired position (i.e., at a desired angle) or, alternatively, the baffle 1024 may be controlled via a cable so that the angle or position of the baffle 1024 may be varied dynamically (i.e., while the towable device is being towed through a body of water). Still further, the nozzle body 1022 may be mounted on a pivot 1030 so that the nozzle assembly 1020 may be rotated in an identical or similar manner to the nozzles 1004 described above in connection with FIGS. 25 and 26.

Figure 27:
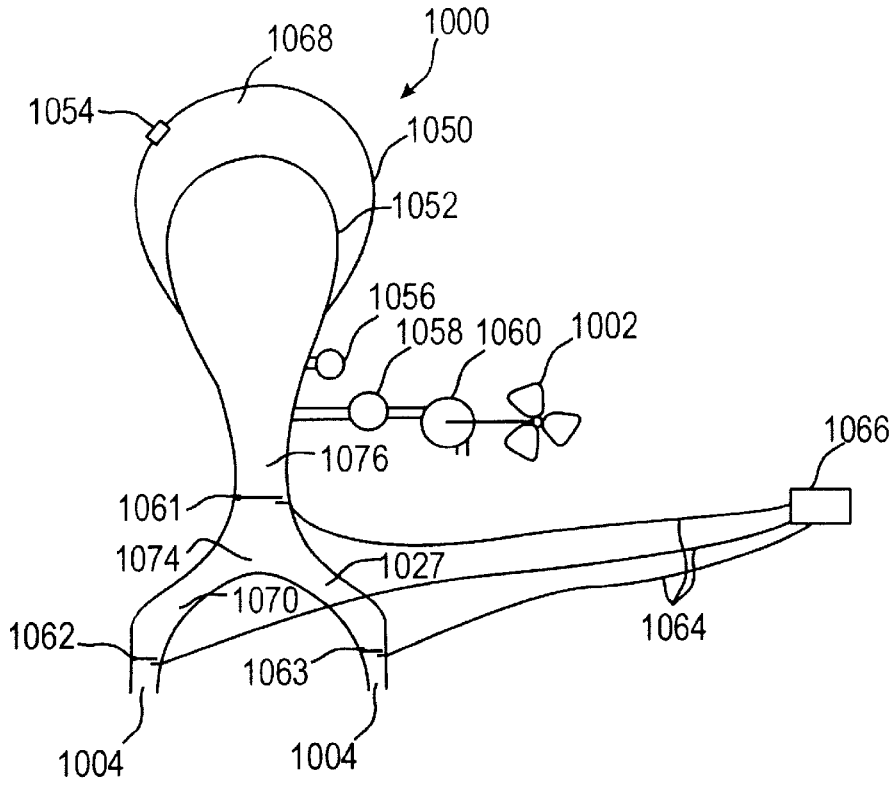
FIG. 27 is a more detailed diagrammatic view of the propulsion system shown in FIGS. 25 and 26.

FIG. 27 is a more detailed diagrammatic view of the propulsion system 1000 shown in FIGS. 25 and 26. As shown in FIG. 27, the propulsion system 1000 includes a storage tank 1050, a water bag or bladder 1052, an air valve 1054, a pressure relief valve 1056, a check valve 1058, a pump 1060, water release or gate valves 1061,1062 and 1063, valve control cables 1064 and a valve switch 1066.

In operation, as the towable device is pulled through a body of water, the water turbine 1002 drives the pump 1060 to cause water to be pumped through the check valve 1058 into the bladder 1052. As water is pumped into the bladder 1052, the pressure within the bladder 1052 increases and the bladder 1052 expands into an air cavity 1068 formed between the bladder 1052 and the tank 1050. If desired, additional pressure may be provided via the air valve 1054, which may, for example, be a Schrader type valve, or any other suitable valve, that is connected to a source of high pressure air or and other suitable pressurized gas. The pressure relief valve 1056 prevents dangerous or potentially damaging pressures from being developed within the bladder 1052 and storage tank 1050.

As shown in FIG. 27, two of the water release gates 1062 and 1063 are located adjacent to the nozzles 1004 within respective output passages 1070 and 1072 of a manifold 1074. The third or primary water release gate 1061 is located between the passages 1070 and 1072 and an input passage 1076 of the manifold 1074 that receives high pressure water from the bladder 1052.

The water release gates 1061–1063 are controlled via the release cables 1064 and the switch 1066. In operation, the water release gates 1061–1063 may be opened and closed in various combinations to produce a desired thrust characteristic. By way of example, if the water release gates 1062 and 1063. are set to an open condition (i.e., allowing the passage of high pressure water through the gate) and if the primary water release gate 1061 is initially closed and then rapidly opened, an approximately equal thrust may be delivered at the outputs of the nozzles 1004. Of course, a similar condition (i.e., approximately equal thrusts) may be achieved by setting the primary water release gate 1061 in an open condition while the gates 1062 and 1063 are initially in a closed condition and then are suddenly opened. Also, for example, the water release gates 1062 and 1063 may be opened in an unequal manner to facilitate certain maneuvers such as rolling about the longitudinal axis of the towable device.

Figure 28:
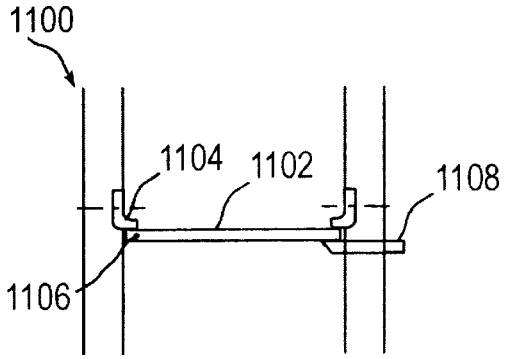
FIGS. 28 and 29 are exemplary cross-sectional views of a water release gate assembly that may be used with the towable device propulsion system.

FIG. 28 is an exemplary cross-sectional view of a water release gate assembly 1100 that may be used with the towable device propulsion system described herein. As shown in FIG. 28, the water release gate assembly 1100 includes a gate 1102, a sealing ring 1104, a hinge 1106 and a release latch 1108. In operation, the gate 1102 may initially be closed and the release latch 1108 may be positioned so that the gate 1102 bears against the sealing ring 1104 to prevent high pressure water from passing through the gate assembly 1100. An operator may open the gate 1102 by activating the valve switch, which may then actuate one or more of the cables 1064 to force the gate into an open condition. It should be recognized that the gate assembly shown in FIG. 28 is particularly well suited for use within water passages having a rectangular cross section.

Figure 29:
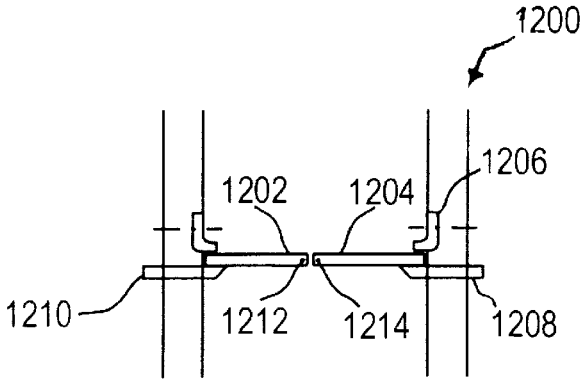

FIG. 29 is an exemplary cross-sectional view of another water release gate assembly 1200 that may be used with the towable device propulsion system described herein. As shown in FIG. 29, the water release gate assembly 1200 includes a pair of gates 1202 and 1204, a sealing ring 1206 and release latches 1208 and 1210. The water release gate assembly 1200 shown in FIG. 29 operates in a manner similar to the water release gate assembly 1100 shown in FIG. 28 except that the water release gate assembly 1200 uses two gates (i.e., gates 1202 and 1204) that pivot on respective hinges 1212 and 1214. The water release gate assembly 1200 is particularly well suited for use in water passages having a circular or elliptical cross section.

Figure 30:
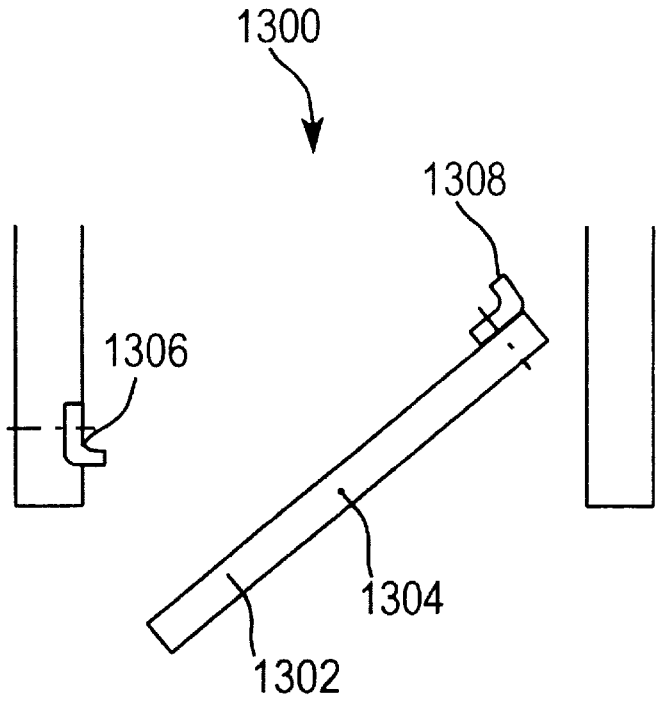
FIGS. 30 and 31 are exemplary cross-sectional views of yet another water release gate assembly that may be used with the towable device propulsion system.
Figure 31:
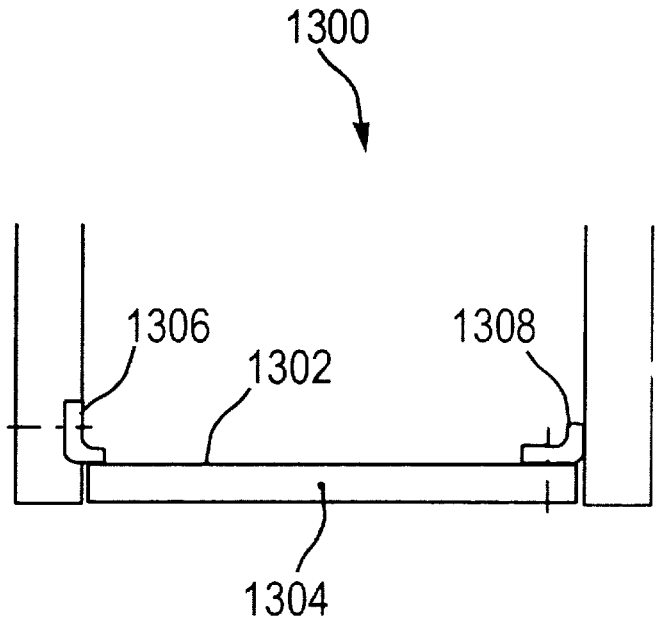

FIGS. 30 and 31 depict exemplary cross-sectional views of yet another water release gate assembly 1300 that may be used with the towable device propulsion system described herein. The water release gate assembly 1300 is configured to be mounted adjacent to the exits of a nozzle such as, for example, the nozzles 1004 shown in FIGS. 24–27. As shown in FIGS. 30 and 31, the water release gate assembly 1300 includes a gate 1302 that is rotatable about a central pivot or hinge 1304. The water release gate assembly 1300 further includes a pair of half sealing rings 1306 and 1308 that prevent the flow of water through the assembly 1300 when the gate 1302 is in a closed condition as depicted in FIG. 31. It should be recognized that the water release gate assembly 1300 may be used to control both the amount and direction in which thrust is provided by the nozzles of the above-described propulsion system.

The towable device described herein may be adapted for use in a variety of applications including, but not limited to, recreational water sports, underwater salvage operations, search and rescue operations, etc. It may be desirable for some applications to attach electric lights to the towable device to improve underwater visibility for the operator, particularly for search and rescue and salvage operations. Additionally, it may also be desirable to provide a hardwired or wireless communication system that enables the operator of the towable device to communicate with the operator of the tow vehicle, other towable device operators, and any other persons. Still further, the towable device described herein may be provided with instrumentation such as, for example, speed indicators, depth gauges, virtual horizon indicators, absolute time clocks, elapsed time clocks, air reservoir tank pressure indicators, breathable air consumption rate indicators, remaining air supply indicators (based on consumption rate), sonar imaging instruments, etc.

While the towable device is generally described herein as being adapted for use by a single operator, the towable device could also be adapted for simultaneous use by two or more people. For example, the towbar assembly and/or chassis may be modified to enable additional operators and/or passengers to be carried by the towable device. Additional operators and/or passengers may be situated either behind or next to a first or primary operator.

Still further, it should be recognized that while the control members of the towable device described herein are described as being manipulated by an operator's hands, the control members may, alternatively, be manipulated by the operator's feet and/or legs without departing from the scope and spirit of the invention. Still further, while the foregoing description indicates that hand grips may be located between the towline connector and the respective control members, the handgrips may instead be positioned so that the control members are between the towline connector and the respective handgrips.

While the invention has been described with reference to specific examples, which are intended to be illustrative only and not to be limiting of the invention, it will be apparent to those of ordinary skill in the art that changes, additions or deletions may be made to the disclosed embodiments without departing from the spirit and the scope of the invention.

What is claimed is:

1. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar;

a towline connector fixed to the towbar between the first and second grips;

a chassis disposed between the control members that includes a fairing portion adapted to deflect water; and an air supply reservoir mounted to the chassis.

2. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar;

a towline connector fixed to the towbar between the first and second grips;

a chassis disposed between the control members that includes a fairing portion adapted to deflect water; and a rudder that pivots about an axis of the chassis to cause the device to move laterally.

3. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar;

a towline connector fixed to the towbar between the first and second grips; and a chassis disposed between the control members that includes a fairing portion adapted to deflect water and an elongated lower portion that is adapted to hold a human operator.

4. The device of claim 3, wherein the chassis further includes a rudder that pivots about an axis of the chassis to cause the device to move vertically.

5. The device of claim 3, further comprising a buoyant pad fixed to the chassis and adapted to lie between the human operator and the elongated lower portion of the chassis.

6. The device of claim 3, wherein the chassis further includes an elongated upper portion opposite the elongated lower portion that is adapted to substantially cover the human operator.

7. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar;

a towline connector fixed to the towbar between the first and second grips; and first and second gear sets interposed between respective ones of the first and second control members and the first and second grips.

8. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar;

a towline connector fixed to the towbar between the first and second grips; and an air supply line that is adapted to deliver air to a human operator from a remote location.

9. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar, wherein each of the first and second grips includes an outer perimeter defining an opening and having first and second opposing sides, each of which is integral with the towbar and wherein each of the first and second grips includes an elongated gripping portion that traverses the opening and which has a longitudinal axis that forms a non-zero angle with respect to the longitudinal axis of the towbar; and a towline connector fixed to the towbar between the first and second grips.

10. The device of claim 9, wherein the first and second end portions of the towbar include respective first and second shafts that are rotatably coupled to the towbar and wherein the first control member is fixed to the first shaft and the second control member is fixed to the second shaft.

11. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar, wherein each of the first and second grips includes an elongated gripping portion and a shaft portion spaced from the elongated gripping portion; and a towline connector fixed to the towbar between the first and second grips.

12. The device of claim 11, wherein the towbar includes first and second bores substantially equidistant from the towline connector for receiving respective ones of the shaft portions and wherein the first and second bores have respective axes that are substantially transverse to the longitudinal axis of the towbar.

13. The device of claim 12, wherein each of the shaft portions includes a threaded portion for varying a distance between its elongated gripping portion and the longitudinal axis of the towbar.

14. The device of claim 12, wherein the towbar further includes third and fourth bores that have respective longitudinal axes which intersect the respective longitudinal axes of the first and second bores and wherein each of the shaft portions includes a plurality of bores and one of the plurality bores in each of the shaft portions is substantially coaxially aligned with a respective one of the third and fourth bores to enable respective pins to pass through the towbar and each of the shaft portions to fix the first and second grips to the towbar.

15. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar, wherein each of the control members includes a respective leading edge and a plurality of mounting holes having longitudinal axes that are substantially parallel to the longitudinal axis of the towbar and which are different distances from the leading edge of the control member; and a towline connector fixed to the towbar between the first and second grips.

16. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar, wherein the each of the control members includes a leading edge and a passage there through having an oblong cross section through which one of the first and second end portions of the towbar passes, and wherein each of the control members includes an adjusting screw that moves the control member with respect to the towbar to vary the distance between the leading edge of the control member and the longitudinal axis of the towbar; and a towline connector fixed to the towbar between the first and second grips.

17. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar, wherein each of the control members includes a trailing edge portion that pivots about an axis that is substantially parallel to the longitudinal axis of the towbar; and a towline connector fixed to the towbar between the first and second grips.

18. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar; and a towline connector fixed to the towbar between the first and second grips, wherein the towline connector includes a curved arm having a first arm portion, a second arm portion and a pivot that lies between the first and second arm portions, wherein the first arm portion is adapted to stop against a surface of the device and wherein the second arm portion includes a notch for receiving a pin that locks the first arm portion against the surface.

19. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar;

a towline connector fixed to the towbar between the first and second grips; and a buoyant indicator coupled to a towline attached to the towline connector.

20. A device for use in water surface and subsurface travel, the device comprising:

a towbar having first and second end portions;

a first control member rotatably coupled to the towbar adjacent to the first end portion, wherein the first control member has a first control surface and a second control surface opposite the first control surface;

a second control member rotatably coupled to the towbar adjacent to the second end portion and spaced from the first control member, wherein the second control member has a third control surface and a fourth control surface opposite the third control surface;

first and second grips spaced apart and fixed to the towbar between the first and second control members so that rotation of the first and second grips about a longitudinal axis of the towbar causes the first and second control members to rotate about the longitudinal axis of the towbar;

a towline connector fixed to the towbar between the first and second grips;

a chassis disposed between the control members that includes a fairing portion adapted to deflect water; and a propulsion unit fixed to the chassis.

21. The device of claim 20, wherein the propulsion unit includes a water turbine, a pressurized water storage unit that receives pressurized water from the water turbine, a nozzle, and a water release valve that controls a flow of pressurized water from the pressurized water storage unit to the nozzle.

22. A towable device for traveling in water, comprising:

a rigid frame member having a longitudinal axis;

a first control member rotatably coupled to the rigid frame member;

a second control member spaced from the first control member along the longitudinal axis of the rigid frame member and rotatably coupled to the rigid frame member;

a grip fixed to the rigid frame member between the first and second control members so that rotation of the grip about the longitudinal axis of the rigid frame member causes one of the first and second control members to rotate about the longitudinal axis of the rigid frame member;

a towline connector fixed to the rigid frame member between the first and second control members; and a chassis fixed to the rigid frame member and disposed between the first and second control members, wherein the chassis includes an elongated lower portion that is adapted to hold a human operator.

23. The device of claim 22, further comprising a buoyant pad fixed to the elongated lower portion and adapted to lie between the human operator and the elongated lower portion of the chassis.

24. The device of claim 22, wherein the chassis further includes an elongated upper portion opposite the elongated lower portion that is adapted to substantially cover the human operator.

25. The device of claim 22, wherein the chassis further includes a fairing portion adapted to deflect water away from the human operator.

26. The device of claim 22, further comprising a rudder that pivots about an axis of the chassis to cause the device to move vertically.

27. A towable device for traveling in water, comprising:

a rigid frame member having a longitudinal axis;

a first control member rotatably coupled to the rigid frame member;

a second control member spaced from the first control member along the longitudinal axis of the rigid frame member and rotatably coupled to the rigid frame member;

a grip fixed to the rigid frame member between the first and second control members so that rotation of the grip about the longitudinal axis of the rigid frame member causes one of the first and second control members to rotate about the longitudinal axis of the rigid frame member;

a towline connector fixed to the rigid frame member between the first and second control members;

a chassis fixed to the rigid frame member and disposed between the first and second control members; and a propulsion unit mounted to the chassis.

28. The device of claim 27, wherein the propulsion unit includes a water turbine, a pressurized water storage unit that receives pressurized water from the water turbine, a nozzle, and a water release valve that controls a flow of pressurized water from the pressurized water storage unit to the nozzle.

29. A device for use in water surface and subsurface travel, comprising:

a towbar having a longitudinal axis;

a first control member rotatably coupled to the towbar, wherein the first control member is rotatable about the longitudinal axis of the towbar;

a second control member rotatably coupled to the towbar, wherein the second control member is rotatable about the longitudinal axis of the towbar independently from the first control member;

a connector fixed to the towbar for connecting the towbar to a towline; and a third control member that is rotatable about an axis substantially transverse to the longitudinal axis of the towbar to cause the device to move one of laterally and vertically.

30. The device of claim 29, further comprising a handgrip for rotating one of the first and second control members about the longitudinal axis of the towbar.

31. The device of claim 29, further comprising a chassis disposed between the control members that includes a fairing portion adapted to deflect water away from a human operator.

32. The device of claim 28, further comprising a chassis disposed between the control members that includes an elongated lower portion for holding a human operator.

* * * * *